US009631594B2

(12) United States Patent
Harvey et al.

(10) Patent No.: US 9,631,594 B2
(45) Date of Patent: Apr. 25, 2017

(54) ANTI-ROTATION CLIP FOR A TWIST LOCK FUEL INJECTOR

(71) Applicant: Hitachi Automotive Systems Americas Inc.

(72) Inventors: William T. Harvey, Brighton, MI (US); Steven J. Miller, Livonia, MI (US); Hiroaki Saeki, West Bloomfield, MI (US); Jeffrey P. Mara, Livonia, MI (US)

(73) Assignee: HITACHI AUTOMOTIVE SYSTEMS AMERICAS INC., Harrodsburg, KY (US)

( * ) Notice: Subject to any disclaimer, the term of this patent is extended or adjusted under 35 U.S.C. 154(b) by 26 days.

(21) Appl. No.: 14/172,341

(22) Filed: Feb. 4, 2014

(65) Prior Publication Data

US 2014/0151469 A1 Jun. 5, 2014

Related U.S. Application Data

(63) Continuation of application No. 13/042,507, filed on Mar. 8, 2011, now Pat. No. 8,646,434, which is a continuation-in-part of application No. 12/852,905, filed on Aug. 9, 2010, now Pat. No. 8,813,722.

(51) Int. Cl.
*F02M 55/00* (2006.01)
*F02M 61/14* (2006.01)

(52) U.S. Cl.
CPC ..... *F02M 61/14* (2013.01); *F02M 55/005* (2013.01); *F02M 2200/852* (2013.01); *F02M 2200/853* (2013.01)

(58) Field of Classification Search
CPC ..... F02M 61/14; F02M 55/005
USPC ..... 239/600, 533.2, 585.1; 123/470, 456; 285/305, 360, 369
See application file for complete search history.

(56) References Cited

U.S. PATENT DOCUMENTS

| | | | | |
|---|---|---|---|---|
| 5,035,224 | A | 7/1991 | Hornby et al. | |
| 6,457,456 | B1 | 10/2002 | Scollard et al. | |
| 7,467,618 | B2 | 12/2008 | Zdroik et al. | |
| 7,556,022 | B1 * | 7/2009 | Doherty | F02M 55/004 123/456 |
| 7,581,530 | B2 | 9/2009 | Scheffel et al. | |
| 7,802,559 | B2 | 9/2010 | Furst et al. | |
| 7,856,962 | B2 | 12/2010 | Harvey et al. | |
| 2007/0175450 | A1 | 8/2007 | Eckbauer et al. | |
| 2009/0184512 | A1 * | 7/2009 | Giorgetti et al. | 285/24 |

OTHER PUBLICATIONS

GM High Feature engine—http://en.wikipedia.org/wiki/GM_High_Feature_engine.com.
GM Family II engine—http://en.wikipedia.org/wiki/GM_Family_II_engine.com.

* cited by examiner

*Primary Examiner* — Arthur O Hall
*Assistant Examiner* — Viet Le
(74) *Attorney, Agent, or Firm* — Mattingly & Malur, PC

(57) ABSTRACT

A fuel injector with an anti-rotation clip for use in conjunction with a twist lock fuel injector inserted into a receiving fuel cup. The clip includes at least one connector leg which extends at least partially over the electrical connector for the fuel injector and locks the clip against rotation relative to the fuel injector electrical connector. A protrusion on a fuel cup arm engages a notch formed in the fuel cup to lock the arm against rotation relative to the fuel cup.

21 Claims, 3 Drawing Sheets

ANTI-ROTATION CLIP FOR A TWIST LOCK FUEL INJECTOR

CROSS-REFERENCE TO RELATED APPLICATION

This application is a continuation of U.S. patent application Ser. No. 13/042,507 filed Mar. 8, 2011, which is a continuation-in-part of U.S. patent application Ser. No. 12/852,905 entitled "Fuel Injector Holder" and filed Aug. 9, 2010, which is incorporated herein by reference.

BACKGROUND OF THE INVENTION

I. Field of the Invention

The present invention relates generally to fuel injector assemblies and, more particularly, to a fuel injector assembly for use with a twist lock fuel injector.

II. Description of Related Art

Many modern day internal combustion engines of the type used in automotive vehicles utilize fuel injectors for injecting fuel into the internal combustion chambers. For example, in a direct injection internal combustion engine, a discharge end of the fuel injector is open directly to the internal combustion chamber.

In order to overcome the high pressures present within the internal combustion engine and still obtain adequate injection of the fuel for a direct injection engine, these previously known fuel injection systems typically include a fuel rail which is pressurized with high pressure fuel. A fuel cup is fluidly connected to the fuel rail for each fuel injector.

An elongated fuel injector is associated with each cup and each fuel injector includes a fuel inlet as well as a fuel outlet. The inlet end of the fuel injector is axially inserted into a cavity formed in its associated fuel cup and the cup and fuel injector are then secured together. Additionally, an electrical connector extends laterally outwardly from each fuel injector for connection to the control system to control the opening and closure of each fuel injector.

There have been several different approaches for connecting the fuel injector to its associated fuel cup. For example, in one type of fuel injector system, a locking clip extends through receiving slots formed in both the fuel cup as well as the injector housing in order to lock the fuel injector and cup together against axial movement. These retaining clips, however, are not only fairly expensive to manufacture, but the installation of such fuel clips is relatively difficult to achieve. This, in turn, increases not only the labor cost of assembling the fuel injectors to the fuel rail, but also the possibility of a fuel injector that is improperly attached to its associated cup.

An improvement to this previously known type of fuel injector system is disclosed in U.S. patent application Ser. No. 12/852,905, entitled "Fuel Injector Holder", filed on Aug. 9, 2010. In this fuel injector system, a twist lock is created between the fuel injector and its associated fuel cup in order to lock the fuel injector and fuel cup together.

Although the twist lock system is fully described in the aforementioned U.S. patent application Ser. No. 12/852,905, in brief the injector body includes an outwardly extending plate attached at a position between its ends. This plate includes at least one radially outwardly extending tab so that the cross-sectional area of the plate is noncircular.

A fuel cup receives the fuel inlet end of the fuel injector and the fuel cup includes a radially inwardly extending ledge at a mid position along the longitudinal length of the cavity. The ledge, furthermore, includes a through bore complementary in shape to the shape of the plate. Consequently, with the fuel injector and plate aligned at a predetermined angular position relative to each other, the plate can pass through the ledge upon insertion of the fuel injector into the cavity. Thereafter, the fuel injector is rotated to a locking position in which the tabs on the injector plate are positioned above the fuel cup ledge thus locking the fuel injector to the fuel cup against longitudinal movement.

In order to retain the fuel injector and fuel cup together, it is necessary to lock the fuel injector and fuel cup together against rotation relative to each other. One prior method to accomplish this was to insert a pin through the fuel cup and into a notch in the fuel injector plate. Although a properly positioned pin proved adequate in preventing relative rotation between the fuel injector and its associated cup, in practice it was difficult not only to assemble the pin to the fuel cup, but also to remove the pin from the fuel cup when removal of the fuel injector was desired.

SUMMARY OF THE PRESENT INVENTION

The present invention provides a fuel injector assembly which overcomes the above-mentioned disadvantages of the previously known devices.

In brief, the present invention provides a fuel injector assembly in which the fuel injector and the receiving fuel cup are twist lock and has an anti-rotation clip locking the injector against rotation relative to the fuel cup. The anti-rotation clip is constructed of a flexible material, such as plastic, which includes at least one connector leg. This connector leg extends at least partially around the fuel injector electrical connector and thus locks the anti-rotation clip against rotation to the fuel injector electrical connector. Preferably, the anti-rotation clip includes a second connector leg which engages the opposite side of the electrical connector so that the electrical connector is entrapped between the first and second connector legs.

A flexible arm has one end attached to the connector leg and a protrusion formed adjacent its opposite end. When the anti-rotation clip is properly positioned around the fuel injector and fuel cup, the protrusion on the arm engages a notch formed in the fuel cup. The cooperation between the protrusion and the fuel cup notch thus mechanically locks the arm, and thus the fuel injector, against rotation relative to the fuel cup. However, because the arm is made of a flexible material, such as plastic, if required, the arm can be bent away from the fuel cup thus moving the protrusion out of the fuel cup notch. When this is done, the fuel injector can be rotated relative to the fuel cup and to the position in which the tabs on the fuel injector plate register with the receiving openings in the fuel cup ledge. The fuel injector can then be pulled out of the fuel cup so that the plate passes through the complementary fuel cup ledge opening.

In practice, the retaining clip may be separate from the fuel injector. However, alternatively, the retaining clip can be integrally formed with the fuel injector.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
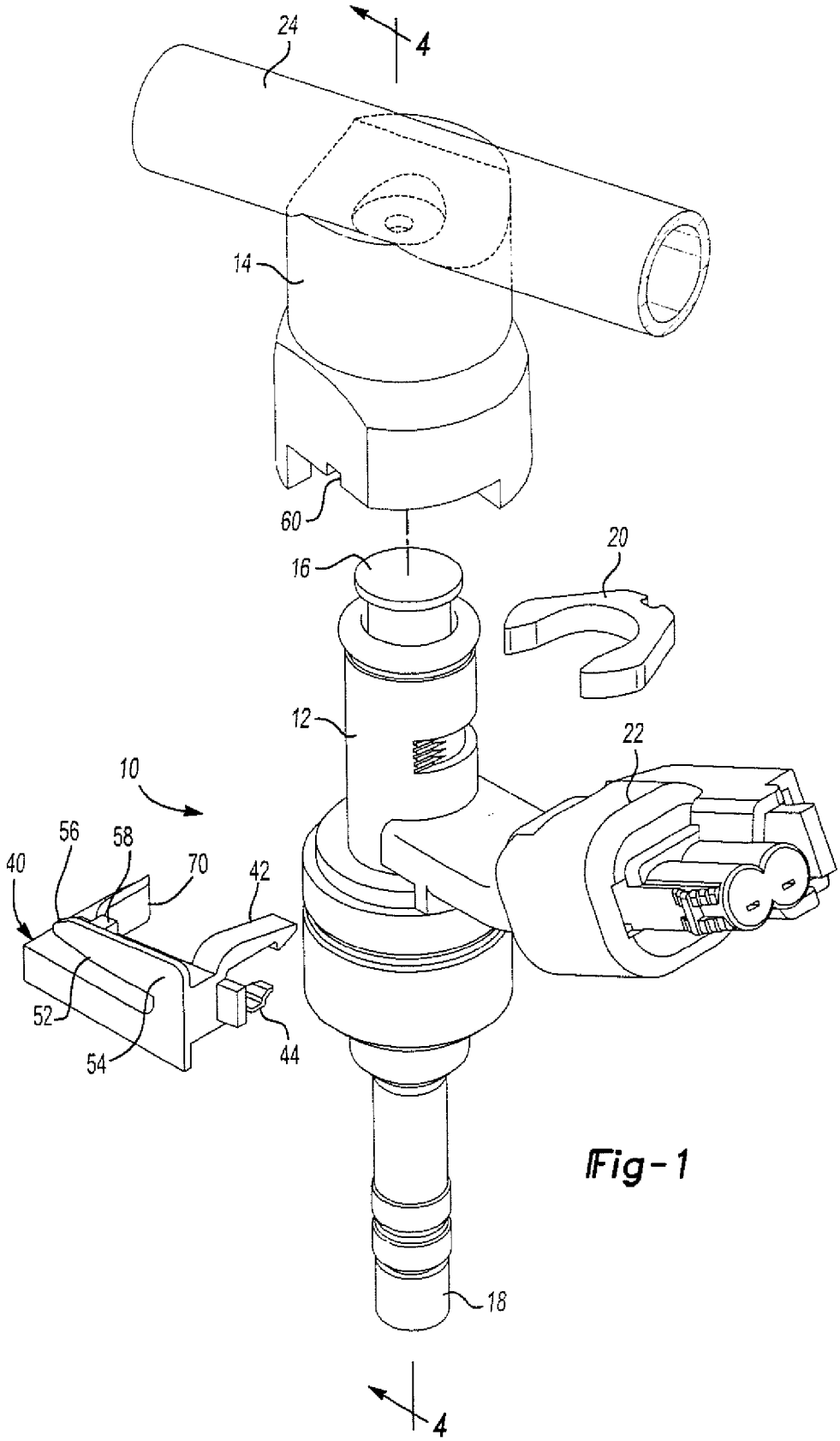
FIG. 1 is an exploded perspective view illustrating a preferred embodiment of the invention.
Figure 2:
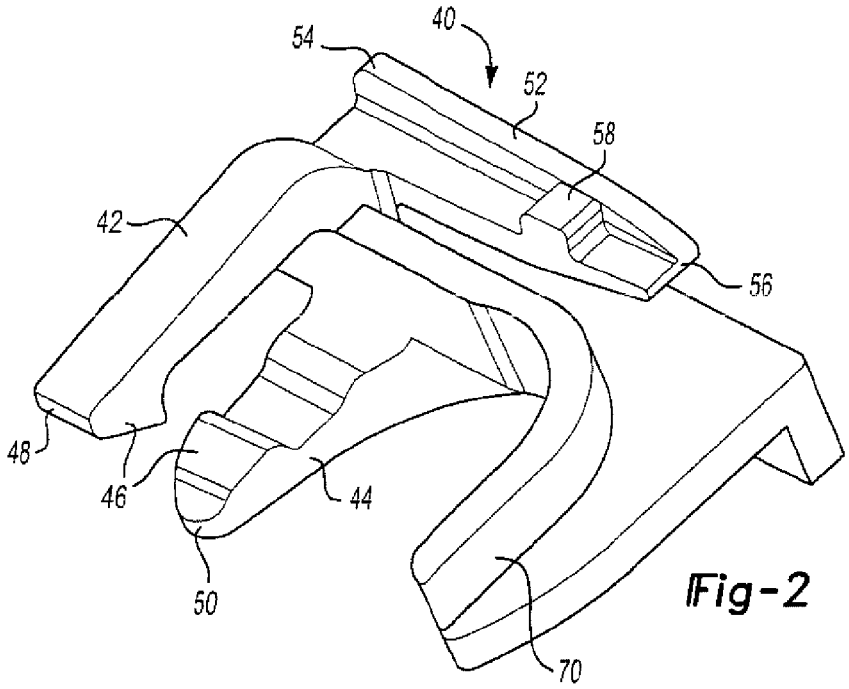
FIG. 2 is an elevational view of a preferred anti-rotation clip.

With reference first to FIGS. 1 and 2, a twist lock fuel injection system 10 is shown having a fuel injector 12 and a fuel cup 14. The fuel injector 12 includes an inlet end 16 and an outlet end 18.

A plate 20 is secured to the fuel injector at a position spaced from its inlet end 16. This plate 20, furthermore, provides a noncircular cross-sectional shape for the fuel injector 12 since the plate 20 is noncircular in shape.

The fuel injector 12 also includes an electrical connector 22 which extends laterally outwardly from the fuel injector 12. The electrical connector is connected to the control system for the engine and receives control signals from the engine control system to control the time of opening and closure of the fuel injector 12.

Figure 4:
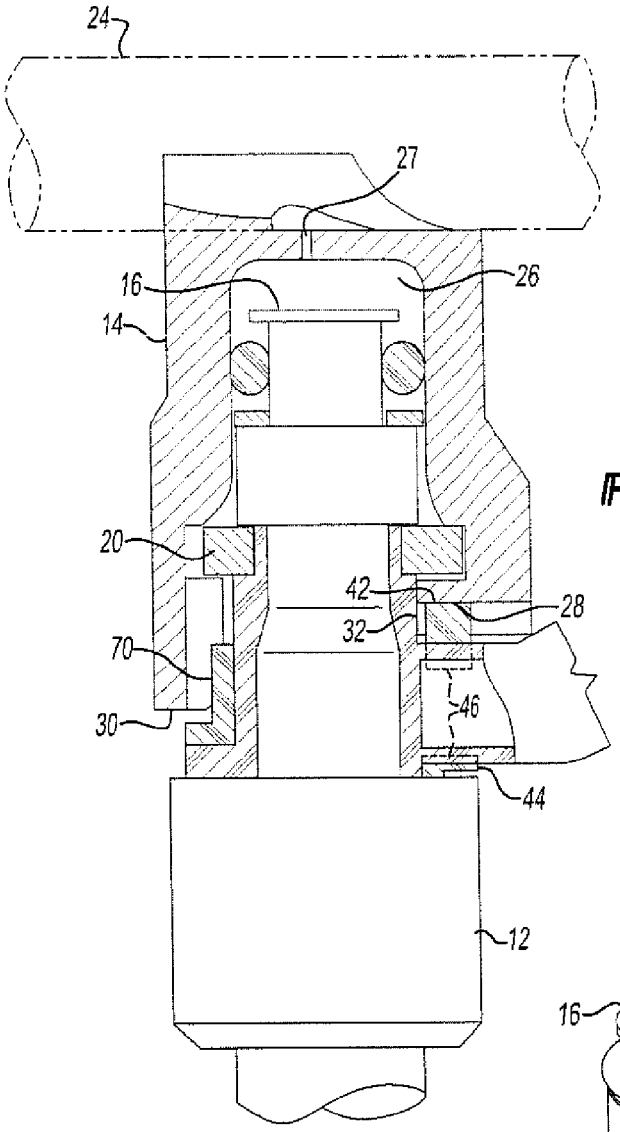
FIG. 4 is a longitudinal sectional view of the preferred embodiment of the present invention.

As best shown in FIGS. 1 and 4, the fuel cup 14 is attached to and fluidly connected to a fuel rail 24 so that the fuel rail 24 is fluidly connected to a fuel chamber 26 inside the fuel cup 14 through a port 27. The fuel cup 14 also includes an inwardly extending ledge 28 adjacent its open end 30. This ledge 28, furthermore, defines an opening 32 that is complementary in shape to the fuel injector plate 20.

Consequently, in order to attach the fuel injector 12 to the fuel cup 14, the fuel injector 12 is angularly aligned with the fuel cup 14 so that the plate 20 registers with the like shaped opening 32 in the ledge 28. At this time, the fuel injector is inserted into the fuel cup 14 so that the plate 20 passes through the opening 32 and is positioned above the ledge 28 as shown in FIG. 4. Rotation of the fuel injector 12, e.g. 90 degrees, then positions the plate 20 above the fuel cup ledge 28 thus locking the fuel cup 14 and fuel injector 12 together against longitudinal or axial movement.

Figure 3:
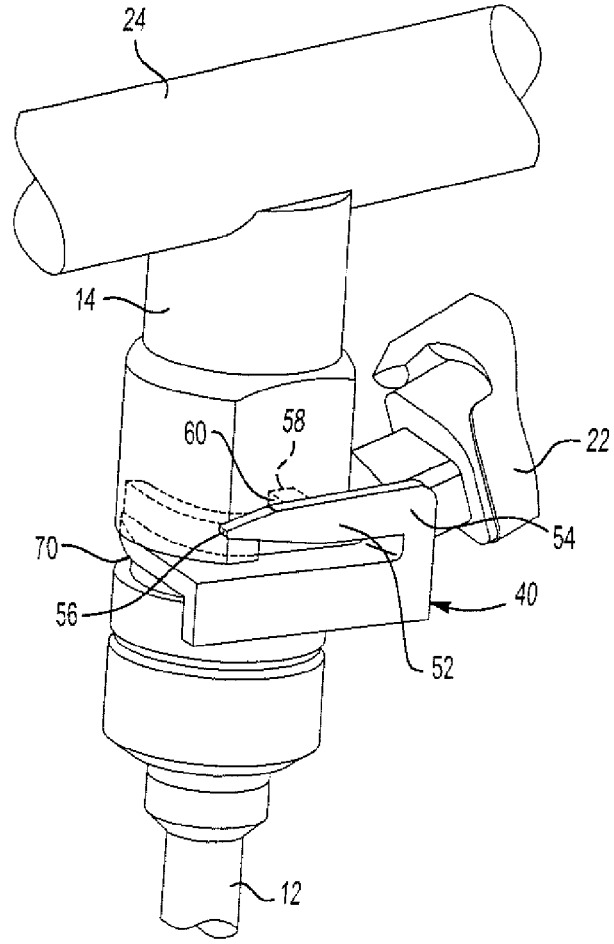
FIG. 3 is an elevational view of the assembled preferred embodiment of the present invention.

With reference now to FIGS. 1-3, an anti-rotation clip 40 is provided to lock the fuel injector 12 and fuel cup together against rotation and the possible separation of the fuel injector 12 from the fuel cup 14. The clip 40 includes at least one, and preferably two connector legs 42 and 44 which are constructed of a rigid, but flexible material, such as plastic. Preferably, at least one connector leg 42 or 44, or both connector legs 42 and 44, include a tang 46 adjacent their free ends 48 and 50, respectively.

Figure 5:
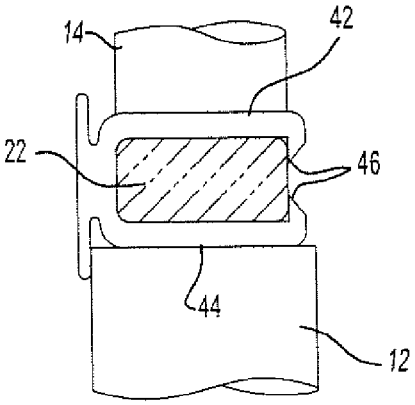
FIG. 5 is a partial sectional view taken through the electrical connector.

As best shown in FIG. 5, the connector legs 42 and 44 are positioned around the electrical connector 22 for the fuel injector 12 so that the connector leg 42 extends around at least a portion of one side of the electrical connector 22. Simultaneously, the second leg 44, if present, extends around the opposite side of the electrical connector 22 such that the electrical connector 22 is at least partially entrapped between the connector legs 42 and 44.

Preferably, the connector legs 42 and 44 are dimensioned and spaced apart from each other by a distance substantially the same as the thickness of the electrical connector 22 adjacent the fuel injector 12. Consequently, as the connector legs 42 and 44 are positioned around the electrical connector 22, the connector legs 42 and 44 abut against opposing sides of the electrical connector 22 and the tangs 46 lock the clip 40 against movement to the electrical connector 22.

Referring now to FIGS. 1-3, the anti-rotation clip 40 also includes an elongated arm 52 which is connected at one end 54 to the connector arm 42 and has a second free end 56. A protrusion 58 is also positioned on the fuel cup arm 52 adjacent its free end 56.

The fuel cup arm 52 is dimensioned so that, with the connector legs 42 and 44 positioned around the electrical connector 22 and the fuel injector 12 inserted into its assembled position, i.e. with the plate 20 positioned above the fuel cup ledge 28, the protrusion 58 registers with a notch 60 (FIG. 1) formed in the lower end 30 of the fuel cup 14. The mechanical interaction between the protrusion 58 and the fuel cup notch 60 thus locks the arm 52 against rotation relative to the fuel cup 14. Since the fuel injector is, in turn, locked against rotation to the clip 40 by the connector legs 42 and 44, the fuel injector 12 is effectively locked against rotation to the fuel cup 14 as desired.

With reference still to FIGS. 1-3, the anti-rotation clip 40 also preferably includes a further connector arm 70 which extends around the fuel injector 12 on the side opposite from the electrical connector 22. This further connector arm 70 thus ensures the proper position and attachment of the anti-rotation clip 40 to the fuel injector 12 and fuel cup 14.

It will be understood, of course, that the anti-rotation clip 40 thus far described has been described as a one-piece component separate from both the fuel injector 12 and the fuel cup 14. As such, the anti-rotation clip 40 may be simply assembled to the twist lock fuel injection assembly 10 by merely pushing the clip 40 onto the assembly 10 after the fuel injector 12 has been locked onto the fuel cup 14.

Alternatively, however, the anti-rotation clip 40 may be preassembled to the fuel injector 12. In this case, once the fuel injector is positioned relative to the fuel cup such that the plate 20 on the fuel injector 12 registers with the complementary opening in the fuel cup ledge 28, the protrusion 60 on the fuel cup arm 52 abuts against the open bottom 30 of the fuel cup 14 thus deflecting the arm 52. As the fuel injector is rotated to its proper assembled position, the protrusion 60 on the arm 52 registers with the notch 60. At this time, the protrusion 58 on the arm 52 enters the notch 60 due to the resiliency of the arm 52 thus locking the fuel injector 12 and fuel cup 14 together against rotation.

Figure 6:
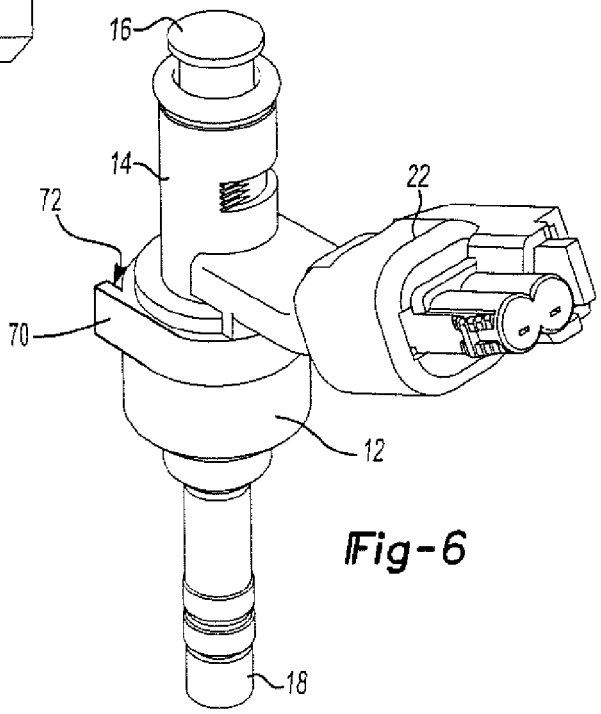
FIG. 6 is an elevational view illustrating a second preferred embodiment of the invention.

In addition, although the anti-rotation clip 40 has been described as a separate component from the fuel injector 12, it will be understood, of course, that the anti-rotation clip 40 may be formed integrally with the fuel injector 12 as shown in FIG. 6. In this case, a resilient arm 70 with a protrusion 72 adjacent a free end of the arm is formed as a part of the fuel injector 12. As before, the fuel injector 12 is inserted into the fuel cup 14 and rotated until the protrusion 58 on the arm 52 snaps into the receiving notch 60 on the fuel cup 14 thus locking the fuel cup 14 and fuel injector 12 together against rotation.

Since the anti-rotation clip 40 is constructed of a flexible material, the clip 40 may be removed from the twist lock fuel injection system 10, or at least the protrusion 58 disengaged from the notch 60, if removal of the fuel injector 12 from the fuel cup 14 is required.

From the foregoing, it can be seen that the present invention provides a simple and yet highly effective anti-rotation clip to prevent rotation of the twist lock fuel injector 12 relative to its fuel cup. Having described our invention, however, many modifications thereto will become apparent to those skilled in the art to which it pertains without deviation from the spirit of the invention as defined by the scope of the appended claims.

We claim:

1. A fuel injector assembly for a direct injection engine comprising:

a fuel rail;

a fuel cup in which a fuel injector is inserted into and having a notch formed on an outside of the fuel cup and in a plane parallel to a plane through said rail and the fuel injector assembly, said fuel cup being preassembled to said fuel rail and open at a downwardly facing end, said notch being formed in said fuel cup so that said notch forms a portion of said downwardly facing end of said fuel cup, said notch facing laterally outwardly from a side of said fuel rail; and the fuel injector having:

an electrical connector extending outwardly from a side of said fuel injector, a clip having two resilient connector legs adapted to grippingly engage an upper and lower surface of said connector, said clip further having a flexible locking arm attached to and extending outwardly from said resilient connector legs, and a protrusion attached to and protruding outwardly from said flexible locking arm of said clip adjacent a free end of said leg, said protrusion dimensioned to extend into said fuel cup notch and thereby prevent rotation of said fuel injector.

2. The fuel injector assembly as defined in claim 1, wherein the locking arm is flexible and resilient.

3. The fuel injector assembly as defined in claim 1, wherein the outside of the fuel cup has a flat surface and the notch is formed in a part of the flat surface, and the locking arm contacts with the flat surface of the fuel cup at a locking position, the locking arm engages the notch in a flat surface of the outside of the fuel cup and locks the fuel injector to the fuel cup.

4. The fuel injector assembly as defined in claim 1, wherein the locking arm is formed integrally with the fuel injector.

5. The fuel injector assembly as defined in claim 1, wherein the locking arm is a part of a clip and the clip is preassembled to the fuel injector as a part of the fuel injector.

6. The fuel injector assembly as defined in claim 1, further comprising:

a plate which being inserted into the fuel injector, wherein the insertion of the fuel injector together with the inserted plate locks the fuel injector and the fuel cup against longitudinal release.

7. The fuel injector assembly as defined in claim 1, further comprising:

a plate which being inserted into the fuel injector, wherein the fuel cup has an opening and inwardly extending ledge inside the cup, and the plate passes through the opening in the fuel cup when the fuel injector is inserted, and the plate and the inwardly extending ledge inside the cup locks the fuel injector and the fuel cup against longitudinal release after the fuel injector is inserted into the fuel cup.

8. A fuel injector for a direct injection engine comprising:

an electrical connector extending outwardly from a side of the fuel injector;

an outlet end; and a locking arm, on the a side of the fuel injector, having a free end and connected at its other end to the fuel injector, the locking arm engaging a notch formed on an outside of a fuel cup and locks the fuel injector to the fuel cup, said notch being formed in said fuel cup so that said notch forms a portion of said downwardly facing end of said fuel cup, a clip having two resilient connector legs adapted to grippingly engage an upper and lower surface of said connector, said clip further having a flexible locking arm attached to and extending outwardly from said resilient connector legs, and a protrusion attached to and protruding outwardly from said flexible locking arm of said clip adjacent a free end of said leg, said protrusion dimensioned to extend into said fuel cup notch and thereby prevent rotation of said fuel injector, wherein said notch lies in a plane parallel to the fuel injector.

9. The injector as defined in claim 8, wherein the locking arm is flexible and resilient, and the protrusion on the locking arm snaps into the notch formed on the outside of the fuel cup so that the fuel injector locks against rotation relative to the fuel cup.

10. The injector as defined in claim 8, wherein the outside of the fuel cup has a flat surface and the notch is formed in a part of the flat surface, and the locking arm contacts with the flat surface of the fuel cup at a locking position, the protrusion of the locking arm engages the notch in a flat surface of the outside of the fuel cup and locks the fuel injector against rotation relative to the fuel cup.

11. The injector as defined in claim 8, wherein the locking arm is formed integrally with the fuel injector.

12. The injector as defined in claim 8, wherein the locking arm is a part of a clip and the clip is preassembled to the fuel injector as a part of the fuel injector.

13. The injector as defined in claim 8, further comprising:

a plate which being inserted into the fuel injector, wherein the rotation of the fuel injector together with the inserted plate locks the fuel injector and the fuel cup against longitudinal release.

14. The injector as defined in claim 8, further comprising:

a plate which being inserted into the fuel injector, wherein the fuel cup has an opening and inwardly extending ledge inside the cup, and the plate passes through the opening in the fuel cup when the fuel injector is inserted, and the plate and the inwardly extending ledge inside the cup locks the fuel injector and the fuel cup against longitudinal release after the fuel injector is twisted in the fuel cup.

15. An automotive vehicle comprising:

an engine control system for a direct injection engine;

a fuel rail;

a fuel cup preassembled to said fuel rail and open at a downwardly facing end and in which a fuel injector is inserted into and having a notch formed on an outside of the fuel cup, said notch lying in a plane parallel to a plane extending longitudinally through the fuel injector, said notch being formed in said fuel cup so that said notch forms a portion of said downwardly facing end of said fuel cup, said notch facing laterally outwardly from a side of said fuel rail; and the fuel injector having:

an electrical connector connected to the engine control system and extending outwardly from a side of said fuel injector, a locking arm, on a side of the fuel injector, having a free end and connected at its other end to the fuel injector, the locking arm engaging the notch formed on the outside of the fuel cup and locks the fuel injector to the fuel cup, a clip having two resilient connector legs adapted to grippingly engage an upper and lower surface of said connector, said clip further having a flexible locking arm attached to and extending outwardly from said resilient connector legs, and a protrusion attached to and protruding outwardly from said flexible locking arm of said clip adjacent a free end of said leg, said protrusion dimensioned to extend into said fuel cup notch and thereby prevent rotation of said fuel injector.

16. The automotive vehicle as defined in claim 15, wherein the locking arm is flexible and resilient.

17. The automotive vehicle as defined in claim 15, wherein the outside of the fuel cup has a flat surface and the notch is formed in a part of the flat surface, and the locking arm contacts with the flat surface of the fuel cup at a locking position, the locking arm engages the notch in a flat surface of the outside of the fuel cup and locks the fuel injector to the fuel cup.

18. The automotive vehicle as defined in claim 15, wherein the locking arm is formed integrally with the fuel injector.

19. The automotive vehicle as defined in claim 15, wherein the locking arm is a part of a clip and the clip is preassembled to the fuel injector as a part of the fuel injector.

20. The automotive vehicle as defined in claim 15, further comprising:

a plate which being inserted into the fuel injector, wherein the insertion of the fuel injector together with the inserted plate locks the fuel injector and the fuel cup against longitudinal release.

21. The automotive vehicle as defined in claim 15, further comprising:

a plate which being inserted into the fuel injector, wherein the fuel cup has an opening and inwardly extending ledge inside the cup, and the plate passes through the opening in the fuel cup when the fuel injector is inserted, and the plate and the inwardly extending ledge inside the cup locks the fuel injector and the fuel cup against longitudinal release after the fuel injector is inserted into the fuel cup.

* * * * *